United States Patent [19]

Pierce

[11] 4,354,314

[45] Oct. 19, 1982

[54] HAND-HELD CUTTER AND BLADE HOLDER FOR CUTTING MOUNTING BOARD AND THE LIKE

[76] Inventor: Donald C. Pierce, 1253 C. Redwood Blvd., Novato, Calif. 94947

[21] Appl. No.: 179,559

[22] Filed: Aug. 19, 1980

Related U.S. Application Data

[63] Continuation-in-part of Ser. No. 55,345, Jul. 6, 1979, Pat. No. 4,262,419, which is a continuation-in-part of Ser. No. 22,423, Mar. 21, 1979, abandoned.

[51] Int. Cl.[3] ..... B26B 29/00

[52] U.S. Cl. ..... 30/293; 30/294

[58] Field of Search ..... 30/293, 294

[56] References Cited

U.S. PATENT DOCUMENTS

| | | | |
|---|---|---|---|
| 42,087 | 5/1864 | Todd . | |
| 235,493 | 12/1880 | Barton | 30/294 |
| 262,218 | 8/1882 | Geiger . | |
| 1,211,777 | 1/1917 | Stanfield | 30/294 |
| 1,705,882 | 3/1929 | Springer | 30/293 |
| 2,610,399 | 9/1952 | Adams et al. | 30/294 |
| 2,674,038 | 4/1954 | Twiss | 30/293 |
| 2,818,644 | 1/1958 | Crawford | 30/293 |
| 2,924,010 | 2/1960 | Umholtz | 30/293 |
| 3,133,350 | 5/1964 | Benson | 30/293 |
| 3,726,010 | 4/1973 | Yokoyama | 30/293 |
| 3,991,467 | 11/1976 | Yokoyama | 30/243 |
| 4,064,626 | 12/1977 | Meshulam | 30/287 |
| 4,095,341 | 6/1978 | Crain | 30/294 |

FOREIGN PATENT DOCUMENTS

| | | | |
|---|---|---|---|
| 970406 | 6/1950 | France | 30/294 |
| 68020 | 9/1929 | Sweden | 30/293 |
| 124271 | 3/1949 | Sweden | 30/294 |

*Primary Examiner*—Stephen G. Kunin
*Assistant Examiner*—J. T. Zatarga
*Attorney, Agent, or Firm*—Owen, Wickersham & Erickson

[57] ABSTRACT

A cutter employing flat replaceable blades in a support member that is shaped as a cube having indentations in its sides to facilitate grasping. The cube is divided into two sides which are held together by adjustable securing means. The blade is inserted in a receiving slot, a plurality of such slots preferably being disposed through the mid-section of the cube at several different angles with respect to the surfaces to be cut. The blade is held in place by positioning it in the slot which corresponds to the desired cutting angle, inserting it to the desired cutting depth and then tightening the adjustable securing means. The cutter is adapted to being guided by a straightedge or to being used for making freehand cuts. The bottom surface of the cutter is shaped to avoid tearing the surface of the mounting board being cut.

8 Claims, 6 Drawing Figures

HAND-HELD CUTTER AND BLADE HOLDER FOR CUTTING MOUNTING BOARD AND THE LIKE

RELATED PATENT APPLICATION

This application is a continuation-in-part of application Ser. No. 55,345, filed July 6, 1979, now U.S. Pat. No. 4,262,419 dated Apr. 21, 1981, which was a continuation in part of application Ser. No. 22,423, filed Mar. 21, 1979, now abandoned.

BACKGROUND OF THE INVENTION

This invention relates to an improved hand-held cutter for use in cutting mounting board and like materials.

A standard cutter, long in use for this purpose, and known as the Dexter cutter, is described and claimed in expired U.S. Pat. No. 2,924,010. The Dexter cutter enables the use of replaceable cutting blades while enabling adjustment of both the cutting angle and the cutting depth. However, one cannot adjust the cutting depth without losing the cutting angle and requiring its resetting.

Prior-art cutters have been relatively heavy, have occasioned inconvenience in use, have enabled only rather narrow adjustment of the cutting angle, and have even tended to tear mats when making a straight cut. Prior-art cutters have also had a rather high coefficient of friction against the surface being cut, so that cutting has ofter required a considerable amount of manual force.

The application of which the present invention is a continuation-in-part, Ser. No. 55,345, teaches a sophisticated hand-held cutter which permits setting and adjusting the cutting angle to any desired position within a range of 45° on either side of vertical. It also is adapted for use with a straight edge as a guide and for making circular cuts by attaching a radius rod to it. The device solves the problems of the prior art, but it is relatively expensive, being directed to the needs of the professional.

Need has also arisen for an inexpensive hand-held cutter to be used by amateurs for cutting mounting board and the like at a pre-set angle. The inexpensive cutter should be compact, light, and able to accomodate a variety of types of blades. Furthermore the device should be adapted to be drawn against a straightedge or ruler for making straight cuts. The device should not tear or mark the surface of the object being cut.

It is therefore an object of the present invention to provide an inexpensive hand-held cutter for use generally by persons unskilled in the art of mounting pictures, to cut mat board and the like.

It is a further object of the present invention to provide a simple cutter which may be easily pushed or pulled whether the user is right-handed or left-handed.

Still another object of the invention is to provide an inexpensive hand-held cutter which will house a variety of types of blades at a plurality of pre-selected cutting angles, while keeping the depth of the cut constant, though adjustable for cutting cleanly through a mat or partially through to provide a groove.

Yet another object of the invention is to provide an inexpensive blade holder for blades used in a hand-held cutter, which is light in weight, adaptable to a variety of blade types and cutting angles, is not prone to tearing or marking the surface being cut, and is designed to be optionally used with a straightedge ruler for making straight cuts but easily controllable when cutting freehand designs.

Still other objects and advantages of the invention will become apparent from the following description.

SUMMARY OF THE INVENTION

The invention provides an inexpensive hand-held cutter for cutting mounting board and the like. The cutter is shaped as a cube divided into male and female halves. The outsides of both halves, and the back, are provided with indentations to facilitate grasping the cutter. Extending from the center dividing line into the two halves are a plurality of blade-receiving slots which are pre-set at angles which are most desirable for cutting mat-board. The two halves are held together and the blade is held by them in a chosen position by adjustable attachment or securing means, such as a nut and bolt or a screw disposed between the two halves.

The cutter is primarily used by drawing it against a straightedge or ruler to make perfectly straight cuts; it may also be used freehand, if desired, or against a curved guide. The same cutter may be used conveniently whether the user is right-handed or left-handed. The blade-receiving slots are adapted for a variety of blade types and accommodates minor differences in blade width since the adjustable securing means enables expansion or reduction of the slot width. The front inside area of both halves is provided with a recess that gives an unobstructed view of the mounting board or other object being cut at exactly the point of contact with the blade.

An important feature of the cutter is that it is made from or at least its bottom surface is covered with a low-friction plastic, such as polytetrafluoroethylene, to reduce the coefficient of friction between the cutter and the surface being out. Furthermore, the bottom edges of the cube slope upwardly in the directions of possible movement, thereby reducing the likelihood of tearing or marking the surface of a mat.

DESCRIPTION OF THE PREFERRED EMBODIMENTS

Figure 1:
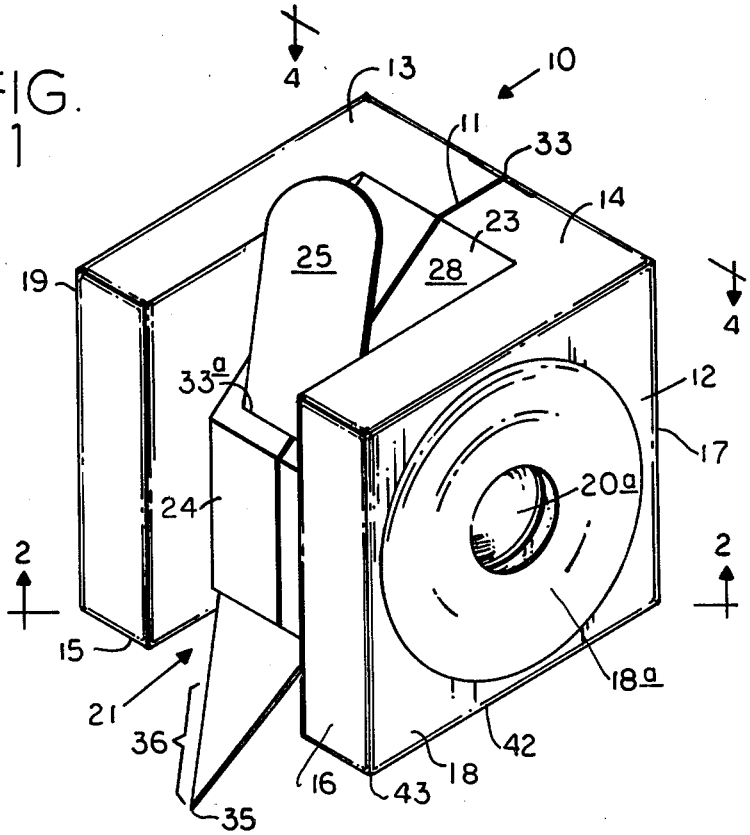
FIG. 1 is an isometric view looking from above and toward one corner of a cutter embodying the principles of the invention.

A hand-held blade holder 10, shown in FIG. 1, is shaped generally as a cube divided along a center line 11 into a male member 12 and a female member 13. The cube has a flat top face 14, a flat bottom face 15, a flat front face 16; into these three faces 14, 15, and 16 extends a major recess 21. The cubic holder also has a recessed rear face 17 and two recessed side faces 18 and 19, the recesses in the faces 17, 18, and 19 being preferably spherical segments 17*a*, 18*a*, and 19*a*, resp., to improve the ability to grasp the cube. The male member 12 and the female member 13 are held together by adjustable securing means 20, which are shown extending through the cube between the centers of the recessed side faces 18 and 19. The adjustable securing means 20 may be a screw extending from one side into a reciprocally threaded screw hole in the other side or may be a nut 20*b* and a bolt 20*a*. Less desirably, they may combine a rubber band wrapped around the outside of the cutter 10.

Figure 2:
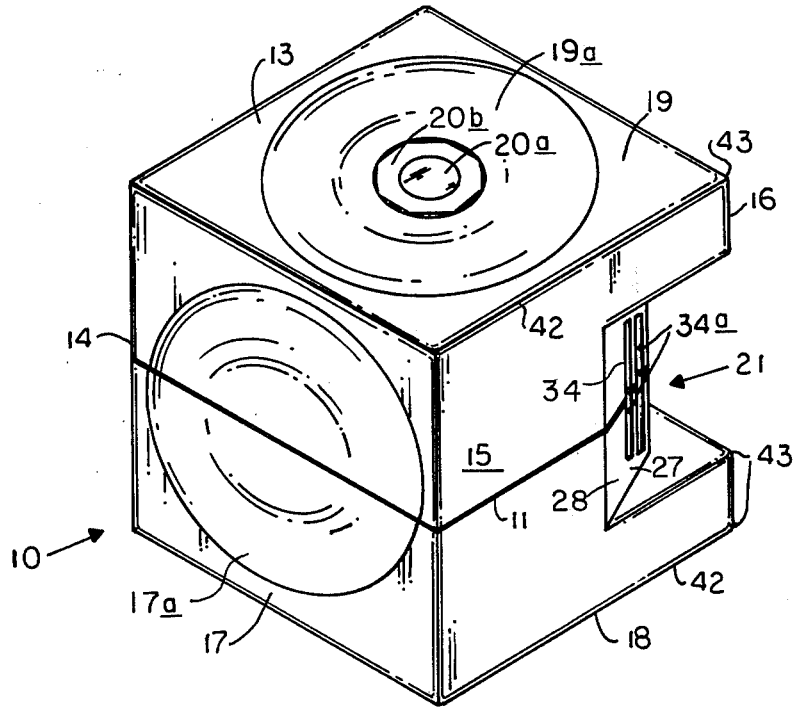
FIG. 2 is an isometric view of the cutter of FIG. 1 lying on its right side, looking along the line 2—2 in FIG. 1.
Figure 4:
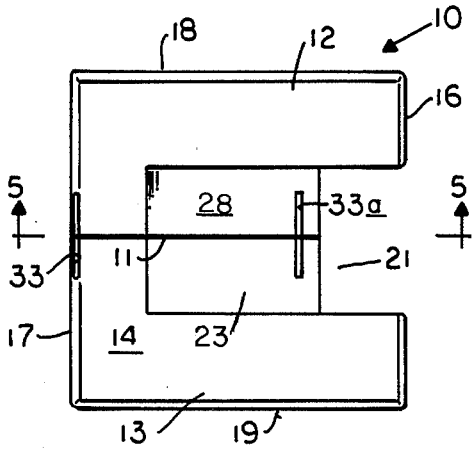
FIG. 4 is a top plan view on a reduced scale of a blade holder portion of the invention taken along line 4—4 in FIG. 1, shown without any blade in place.
Figure 5:
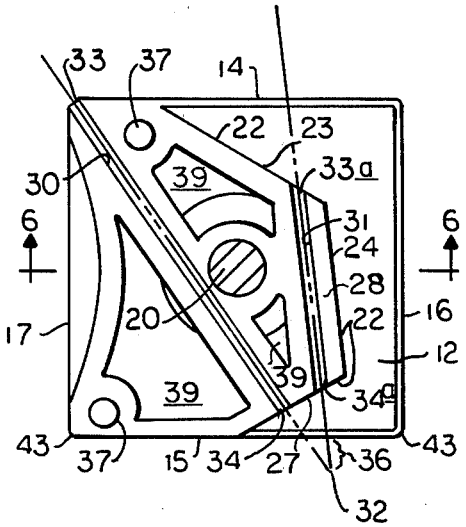
FIG. 5 is a view in section taken along the line 5—5 in FIG. 4 and with broken lines indicating the two blade portions shown.

As illustrated in FIGS. 1, 2 and 4, the major recess 21 extends, preferably, into both elements 12 and 13 an equal distance from the center line 11. The recess 21 extends into the top face 14 from the front face 16, and into the bottom face 15 from the front face 16, and it extends from the top to the bottom of the front face 16. The cross-sectional line taken by the recess 21 is best illustrated in FIG. 5 where the cut-out is identified along a line 22, which really denotes three planes perpendicular to the side faces 18 and 19 of the cube, a planar portion 23 sloping downwardly and forwardly from the rear of the top face 14 to a steeper planar portion 24 that also slopes downwardly and forwardly, and a bottom planar portion 27 sloping downwardly and rearwardly from its intersection with the planar portion 24 to the bottom face 15. The recess 21 privides the operator with an unobstructed view of the point where a cutting blade 25, comes in contact with a surface 26 of the mounting board being cut. The blanar portions 23, 24, and 27 help define a body portion 28 of the cubic holder 10.

As shown in FIG. 5 a plurality of blade receiving slots 30 and 31 are provided, extending through the body 28 of the cube, each half in the male member 12 and half in the female member 13. The slots 30 and 31 are disposed through the cube at pre-selected angles to the bottom face 15. In this manner the blade 25 is held at a constant angle to the surface 26 being cut. As illustrated in FIG. 5 the front slot 31 is provided substantially at an 85° angle to the surface 26 being cut, and the rear slot 30 is provided at substantially a 55° angle to the surface 26 being cut. The slots 30 and 31 are disposed in the cutter 10 so that the planes extending from both slots will intersect at a point 32 approximately the thickness of a standard piece of matting board below the bottom 15 of the cutter 10. Each slot 30, 31 has an upper opening 33 or 33*a* which the blade may be inserted and a lower opening 34 or 34*a* through which a point 35 of an inserted blade 25 extends. The blade 25 is inserted through the slot 30 or 31 until its point 35 extends for thr desired cutting depth 36 beyond the bottom face 15 of the blade holder 10. Once the blade 25 has been set to the desired cutting depth 36, the adjustable securing means 20 is tightened to hold the blade 25 securely in place at that depth in its slot 30 or 31. For the narrowest blades, the two parts 12 and 13 nearly abut; for wider blades, they will be somewhat apart.

Figure 6:
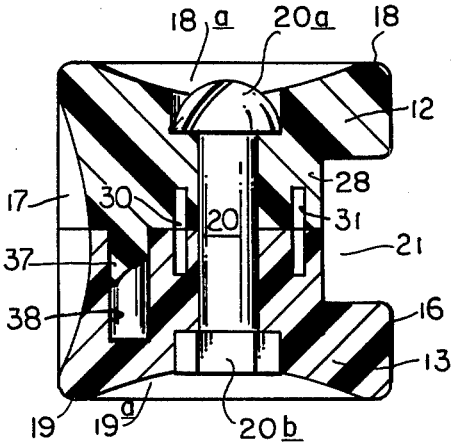
FIG. 6 is a view in section taken along the line 6—6 in FIG. 5, shown without a blade.

Also shown is the cross-sectional views of FIGS. 5 and 6, there are positioning studs 37 each of which project from the male member 12 into a mating cavity 38 within the female member 13, thereby keeping the two members 12 and 13 is alignment and preventing their rotation with respect to each other. In the absence of the alignment means 37, 38, the two members 12 and 13 might be able to rotate with respect to each other when ajdusting the securing means 20. There may be a single positioning stud 37 and cavities or a plurality of them, as shown. For lightness and to save material, the male and female members 12 and 13 may be provided with otherwise non-functional voids 39, as shown in FIG. 5.

Figure 3:
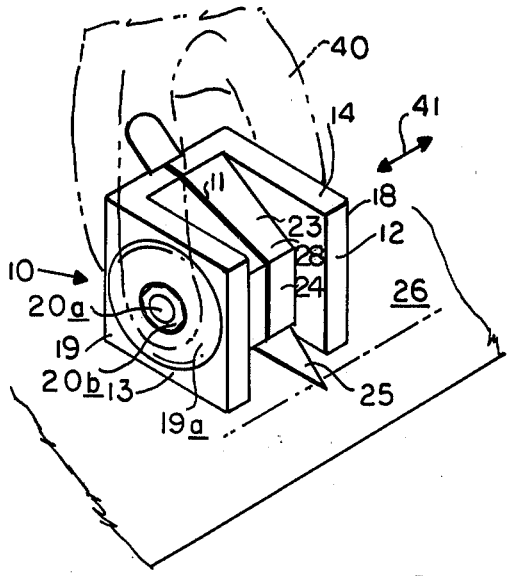
FIG. 3 is an upper left front isometric view on a reduced scale of the cutter of FIG. 1 being used by a human hand (shown in broken lines) to make a cut.

FIG. 3 illustrates how the device is used manually. A user's hand 40 is shown grasping the blade holder 10 by the recessed grasping surfaces 18 and 19. The holder 10 is being moved along line of movement 41, with the blade 25 moving too. By simply untightening the securing means 20, removing the blade 25 and changing its cutting direction, the handheld cutter may be used easily, whether the user is right-handed or left-handed.

An important aspect of the invention is that at least the bottom face 15 of the blade holder 10 is provided with a non-sticking surface or low-friction plastic, such as polytetrafluorethylene. This may be integral with the device or may be a coating. Also, the edges 42 between the bottom face 15 and the faces 16, 17, 18 and 19 are rounded or sloped upwardly to prevent the tearing of the surface 26 being cut. Rounded corners 43 are also provided for this purpose.

The hand-held cutter may be used both in free-style or unassisted cutting or by using a straight edge or ruler to guide the front face 16 of the cutter 10. Compensation must be made when placing the straight edge on the surface 26 to be cut to provide for the distance between the blade point 35 and the edge of the front face 16. This degree of compensation will depend on the depth of cut 36 for which the blade 25 is set and on the angle which has been selected.

The cutter may be constructed of any suitable material including wood, metal and plastic. The cutter may be used to cut leather, gasket material or other sheets, as well as for paper and mats.

To those skilled in the art, various changes in construction and modified embodiment and applications of the invention will be apparent without departing from the spirit and scope of the invention. The described embodiment is illustrative and not intended to be in any sense limiting.

I claim:

1. A hand-held cutter device for cutting mounting board and the like, including in combination:

a generally cube-shaped blade holder comprising two interlocked halves and having a top face, a generally flat front face, a generally flat bottom face, a pair of side faces, and a rear face, said holder having a major recess extending into said top, bottom, and front faces to a body portion extending between the sides of said cube and integral with said rear face, said halves having facing surfaces that nearly meet and extend along planes approximately midway between and generally parallel to said side faces, at least one blade-receiving slot in said body, split between said two halves and lying along a plane perpendicular to the plane of the side faces of the holder and at an angle to the top, front, and bottom faces, a cutting blade in said slot, and adjustable securing means holding said halves together with the blade in said slot, said securing means enabling loosening for insertion of and adjustment of the position of said blade and tightening to hold it in a selected said position.

2. A hand-held blade holding device for blades used in cutting mounting board and the like, including in combination:

a generally cube-shaped blade holder comprising two interlocked halves and having a top face, a generally flat front face, a generally flat bottom face, a pair of side faces, and a rear face, said holder having a major recess extending into said top, bottom, and front faces to a body portion extending between the sides of said cube and integral with said rear face, said halves having facing surfaces that nearly meet and extend along planes approximately midway between and generally parallel to said side faces, at least one blade-receiving slot in said body, split between said two halves and lying along a plane perpendicular to the plane of the side faces of the holder and at an angle to the top, front, the bottom faces, and adjustable securing means holding said halves together, said securing means enabling loosening for insertion of a said blade and adjustment of its position and enabling tightening to hold such a blade in a selected said position.

3. The device of claim 1 or 2 wherein said side and rear faces have generally spherical-segment recesses therein to facilitate grasping of said holder.

4. The device of claim 1 or 2 having a pair of said slots in said body extending therethrough at different angles.

5. The device of claim 4 wherein:

said slots are angularly related to each other so that the planes of the two slots, when extended downwardly, intersect at a point slightly below said bottom wall.

6. The device of claim 1 or 2 wherein said adjustable securing means comprises a bolt extending through an opening through said body and said side faces.

7. The device of claim 1 or 2 wherein the bottom edges and corners of said holder are rounded.

8. The device of claim 6 wherein said bottom face is coated with a low friction plastic and at least one of the edges of said bottom surface sloping upwardly.

* * * * *